United States Patent [19]

Baumann

[11] 4,084,146

[45] Apr. 11, 1978

[54] FUSE ASSEMBLY

[75] Inventor: Erwin L. Baumann, Laguna Beach, Calif.

[73] Assignee: Ford Aerospace & Communications Corporation, Dearborn, Mich.

[21] Appl. No.: 731,883

[22] Filed: Oct. 13, 1976

[51] Int. Cl.[2] ..... H01H 85/16

[52] U.S. Cl. ..... 337/234; 337/297; 339/17 C; 339/256 C

[58] Field of Search ..... 337/191, 197, 234, 236, 337/293, 297; 339/17 C, 31 R, 252 F, 253 F, 256 C, 100 R, 276 R

[56] References Cited

U.S. PATENT DOCUMENTS

| | | | |
|---|---|---|---|
| 2,941,059 | 6/1960 | Sims et al. | 337/297 X |
| 3,492,628 | 1/1970 | Matthews | 339/17 C |
| 3,871,738 | 3/1975 | Dechelette | 339/256 C |

*Primary Examiner*—George Harris

*Attorney, Agent, or Firm*—John J. Roethel; Keith L. Zerschling

[57] ABSTRACT

A fuse assembly having a dielectric base plate and a fuse strip laminated to the base plate. The fuse strip comprises a bus bar and one or more spaced contact portions each joined by a fuse link to the bus bar. At the end of each fuse link the laminate is apertured to receive a fuse clip. The fuse clip is insertable in the aperture and is constructed and arranged to have clamping engagement with the base plate and fuse strip. The fuse clips associated with each fuse link are provided with aligned fuse retention means adapted to receive a substitute fuse link device for electrically bypassing an open fuse link in the fuse strip.

9 Claims, 5 Drawing Figures

FUSE ASSEMBLY

BACKGROUND OF THE INVENTION

A typical fuse block or fuse box assembly which may be found in modern vehicles is a black, plastic, one-piece assembly containing fuse clips, bus bars which electrically interconnects some of the fuse clips, female spade terminals for flasher units, and circuit breaker clips. Assembled into this unit may be as many as nine glass fuses, four circuit breakers and one flasher. Electrical interconnections from the wiring harness to the fuse block are made by crimping the wires to the fuse clips and by mechanically connecting female spade terminals to male spade terminals which are riveted to the bus bars. This completed assembly is then snapped, locked into and mechanically held by the fire wall main harness connectors.

It has been suggested that the fusing of the electrical system of an automobile could be simplified by using fuses printed on a printed circuit board which is then fastened to the electrical harness. U.S. Pat. No. 2,934,627 issued Apr. 26, 1960 to Bristol et al shows a printed circuit board containing printed fuses. The printed circuit board is mounted by means of an edge connector. This embodiment is cheapest for the manufacturer, but expensive for the vehicle owner in that he must replace the complete circuit board of fuses if only one fuse blows.

SUMMARY OF THE INVENTION

The use of a printed wiring board in automotive applications is desirable because of its inherent economy, reliability and simplicity. It has the disadvantage, however, that the failure of one fuse link could require the replacement of the whole fuse board. This disadvantage is overcome by the present invention which is embodied in a fuse assembly comprising a dielectric base plate and a fuse strip laminated to the base plate. The fuse strip comprises a bus bar and one or more contact portions spaced from the bus bar and each other, each contact portion being joined by a fuse link to the bus bar. The laminate is apertured at each end of a fuse link. A fuse clip is received in each aperture, each fuse clip being constructed and arranged to have clamping engagement with the laminate and especially electrical contact with the fuse strip. The fuse clips at each end of a fuse link have aligned fuse retention means adapted to receive a fuse link device and to provide an electrical bypass for any open fuse link in the fuse strip.

DESCRIPTION OF THE DRAWINGS

Further features and advantages of the present invention will be made more apparent as this description proceeds, reference being had to the accompanying drawing, wherein.

DETAILED DESCRIPTION OF THE INVENTION

Figure 1:
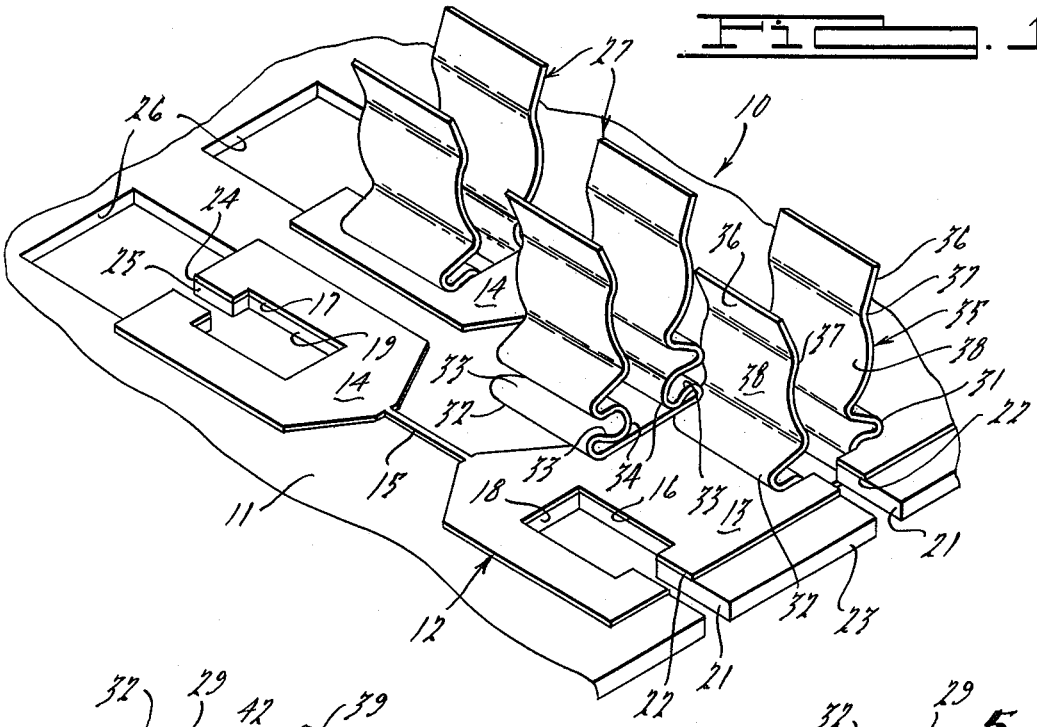
FIG. 1 is a perspective view, in part exploded, of a portion of a fuse assembly in accordance with the present invention.

Referring now to the drawing, there is shown in FIG. 1 a fragmentary portion of a fuse assembly, generally designated 10. The fuse assembly 10 comprises a dielectric base plate 11 and a fuse strip 12 laminated to the upper surface of the base plate.

The fuse strip 12 comprises a bus bar 13 at one end and one or more contact portions 14 spaced from the bus bar 13 and from each other, in the event there is more than one as is shown in FIG. 1. The contact portions 14 are connected to the bus bar 13 by a fuse link 15. The width and thickness of each fuse link is dependent on the amount of current it is designed to carry before it would melt to cause an open circuit.

Preferably, for ease of manufacture the fuse strip 12 is die-stamped. For this reason, it is preferred that the fuse strip be die-stamped from zinc alloy strip. Zinc was compared with other electrical and thermal conductive material. The electrical conductance and melting point of zinc is lower than aluminum, copper or silver. The higher melting points of aluminum, copper and silver would require, however, a smaller fuse width to melt or open as compared to zinc. The difficulty in stamping a fuse increases as its width narrows. Since the fuse link width using zinc alloy is larger than would be necessary if aluminum, copper or silver was used, the zinc alloy is easier to handle in a stamping press.

The fuse strip bus bar 13 and end contact portions 14 have aligned substantially rectangular apertures 16 and 17 adjacent each end of a fuse link 15. The base plate 11 has similarly shaped apertures 18 and 19 in vertical alignment with the fuse strip apertures 16 and 17, respectively.

The base plate 11 and the fuse strip 12 have corresponding access slots 21 and 22 extending inwardly from the edge 23 of the base plate 11 into the apertures 16–18. Similarly, access to the apertures 17–19 is obtained through aligned slots 24 and 25 in the base plate 11 and fuse strip 12, respectively, the slots 24–25 communicating with an enlarged opening 26 in the base plate 11, see FIG. 1.

Figure 2:
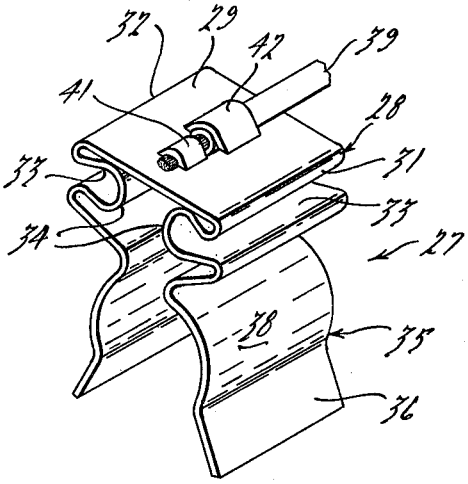
FIG. 2 is an inverted perspective view of a fuse clip illustrating one manner in which a wire may be secured thereto.

The apertures 16–18 and 17–19 are each adapted to receive a fuse clip, generally designated 27, see FIGS. 1 and 2. The fuse clip 27 comprises a planar base portion 28 having clamping means adapted to have clamping engagement with the laminate of the base plate 11 and fuse strip 12 when the fuse clip is positioned in an aperture 16–18 or 17–19. The clamping means on each fuse clip base portion 28 comprises a planar base section 29 having on opposite edges 31–32 outwardly opening resilient bight portions 33. Each bight portion has a loop portion 34, the two loop portions 34 being spaced from each other a distance greater than the width of the slots 21–22 or 24–25.

Appended to each bight portion 33 is a resilient leg or arm 35. Each of the legs 35 at its free end includes an outwardly inclined guide segment 36. The guide segments 36 slope downwardly and inwardly and terminate in reverse bend portions 37 that are integral with semi-arcuate of angular cues engaging segments 38.

Provision is made on the base section 29 of each fuse clip 27 for the attachment of conductors 39. In FIG. 2, base section 29 is shown as having 2 semi-cylindrical wire receiving elements 41–42 lanced out of the base plane. The element 41 receives the conductor wire stripped of its insulation and the element 42 receives the wire and its insulation. The elements 41–42 are crimped or pressed toward the plane of the base to retain the conductor in place.

Figure 3:
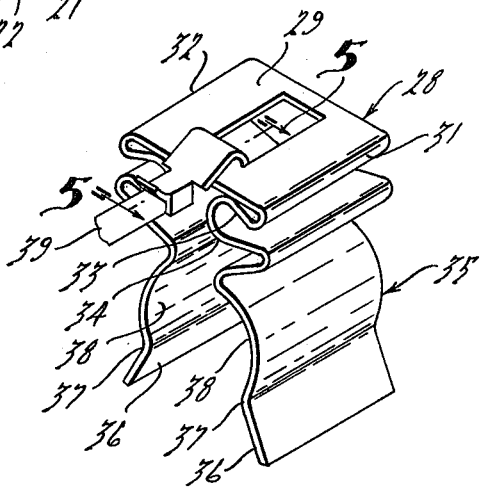
FIG. 3 is a view in part similar to FIG. 2 illustrating a second manner in which a wire may be secured to a fuse clip.
Figure 4:
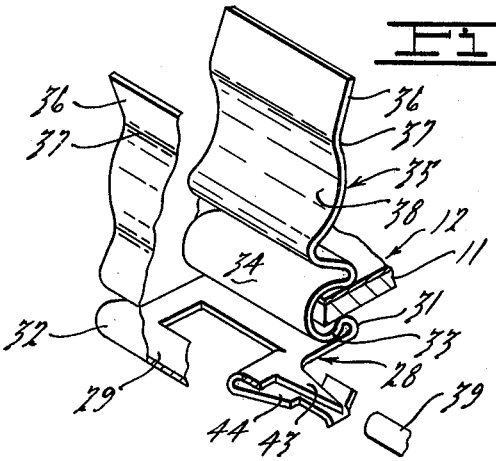
FIG. 4 is a cutaway inverted view of FIG. 3 illustrating in greater detail the connection of a wire to the fuse clip.
Figure 5:
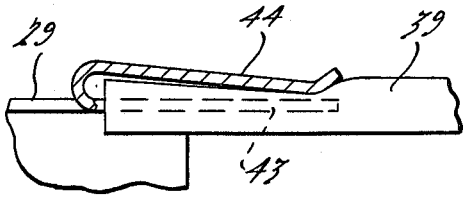
FIG. 5 is a cross section on the line 5—5 of FIG. 3.

FIGS. 3, 4 and 5 disclose the wire receiving or retention means as embodying a "ram" design. The planar base section 29 is formed with a sharpened point on extension 43. and a pressure element 44 lanced out of the base section and overlying the pointed extension 43. With this arrangement it is not necessary to strip the insulation from wire of the conductor 39. It is merely necessary to ram the pointed extension 43 at the fuse clip base endwise into the conductor, as shown in FIG. 5, to make contact between the wire and the fuse clip.

The fuse clips 27 are assembled to the base plate-fuse strip laminate portion as follows:

The resilient leg portions 35 of a fuse clip 27 to be mounted on the laminate are squeezed or compressed toward each other. This causes the loop portions 34 to be moved toward each other sufficiently so that the bight portions 33 can fit through the slots 21–22 leading into an aperture 16–18 or through slots 24–25 leading into an aperture 17–19. Upon release of the compression pressure on the resilient leg portions 35 when the fuse clip 27 is fully aligned within an aperture the bight portion 33 clamps onto the under side of the base plate 11 and the upper side of the fuse strip 12 at each marginal edge of the respective aperture. The enlargement of the fuse clip 27 that occurs upon release of the resilient legs 35 further serves as a retention means preventing inadvertent withdrawal of the fuse clip from the aperture through the slot.

As best seen in FIG. 1, the aligned fuse clips are positioned to receive a conventional glass fuse of a laminated fuse element, neither of which is shown. Thus, if a fuse link 15 is blown or melts because of an electrical malfunction, it is not necessary to replace the entire fuse assembly. It is only necessary to snap a substitute element into the fuse clips to provide a current bypass around blown or melted fuse strip 15. The vehicle manufacturer obtains the advantage of being able to use assemblies that have a lower production price, increased reliability and reduced volume and weight. The vehicle operator is provided with a simple and relatively inexpensive way of bypassing a blown or open fuse link by inserting a conventional glass fuse element in the fuse clips aligned with the open fuse link.

It is to be understood that this invention is not limited to the exact construction illustrated and described above, but that various changes and modifications may be made without departing from the spirit and scope of the invention as defined by the following claims:

I claim:

1. A fuse assembly comprising a dielectric base plate and a fuse strip laminated to the base plate, the fuse strip comprising a bus bar and one or more contact portions spaced from the bus bar and each other and joined by a fuse link to the bus bar, the laminate being apertured at each end of the fuse link, a fuse clip received in each aperture, each fuse clip having clamping means thereon constructed and arranged to have clamping engagement with the laminate and electrical contact with the fuse strip, the fuse clips at each end of a fuse link having aligned fuse retention means adapted to receive a fuse link device to provide an electrical bypass for any open fuse link in the fuse strip.

2. A fuse panel assembly comprising:

a dielectric base plate, a fuse strip of electrically conductive metal laminated to the base plate, the fuse strip having end contact portions connected by a fuse link, the base plate and fuse strip contact portions having aligned apertures, the base plate and fuse strip having corresponding slots therethrough communicating with each aperture to provide an access passageway thereto, and a fuse clip positioned in each aperture, each fuse clip having a base portion insertable into an aperture through an access slot, each fuse clip base portion being constructed and arranged to have clamping engagement with a fuse strip end contact portion when the fuse clip base portion is seated in an aperture, wire receiving means on the base portion of each fuse clip, and fuse retention means on each fuse clip, the fuse retention means being aligned to receive a substitute fuse link device for bypassing an open fuse link in the fuse strip.

3. A fuse panel assembly according to claim 2, in which:

each fuse clip base portion has a substantially planar base section having on opposite edges outwardly opening resilient bight portions, each bight portion having a loop portion spaced from the loop portion of the other bight portion a distance greater than the width of an access slot whereby the bight portions must be flexed toward each other to decrease the space therebetween to permit passage through the access slot, and upon release of the flexing force the bight portions being expandable into the aperture and engaging the wall of the latter to prevent withdrawal therefrom.

4. A fuse panel assembly according to claim 3, in which:

each bight portion is of less width across its opening than the thickness of the base plate and fuse strip laminate whereby upon the bight portions being flexed to pass through an access slot the width of the opening is increased and permits passage over the laminate, and upon release of the flexing force each bight portion clamps on a marginal edge portion of the aperture.

5. A fuse panel assembly according to claim 1, in which:

each fuse clip base portion has a substantially planar base section having on opposite edges outwardly opening resilient bight portions, and each bight portion is of less width across its opening than the thickness of the base plate and fuse strip laminate whereby the bight portions must be flexed to increase the width of the opening to pass the bight portions over the laminate as the fuse clip is passed through the aperture access slot, and upon release of the flexing force each bight portion is clamped on a marginal edge of the aperture.

6. A fuse panel assembly comprising:

a dielectric base plate, and a fuse strip laminated to the base plate, the fuse strip comprising a bus bar and one or more spaced contact portions each connected to the bus bar by fuse links, the fuse strip bus bar and end contact portions having aligned apertures at the end of each fuse link, and the base plate having apertures corresponding to the fuse strip apertures, the base plate and fuse strip having corresponding slots therethrough communicating with each aperture to provide an access passage thereto, and a fuse clip positioned in each aperture, each fuse clip having a base portion insertable into an aperture through an access slot, clamping means on each base portion having clamping engagement with the base plate and fuse strip when the fuse clip is positioned in an aperture, wire receiving means on the base portion of each fuse clip, and fuse retention means on each fuse clip, the fuse retention means being aligned to receive a substitute fuse link device to bypass an open fuse link in the fuse strip.

7. A fuse panel assembly according to claim 6, in which:

the clamping means on each fuse clip base portion comprises a base section having on opposite edges outwardly opening resilient bight portions, each bight portion having a loop portion spaced from the other bight portion loop portion a distance greater than the width of an access slot whereby the bight portions must be flexed toward each other to decrease the space therebetween to permit passage through the access slot, and upon release of the flexing force the bight portions being expandable into the aperture and engaging the wall of the latter to prevent withdrawal therefrom.

8. A fuse panel assembly according to claim 7, in which:

each bight portion is of less width across its opening than the thickness of the base plate and fuse strip laminate whereby upon the bight portions being flexed to pass through an access slot the width of the opening is increased and permits passage over the laminate, and upon release of the flexing force each bight portion clamps on a marginal edge portion of the aperture.

9. A fuse panel assembly according to claim 6, in which:

each fuse clip base portion has a substantially planar base section having on opposite edges outwardly opening resilient bight portions, and each bight portion is of less width across its opening than the thickness of the base plate and fuse strip laminate whereby the bight portions must be flexed to increase the width of the opening to pass the bight portions over the laminate as the fuse clip passes through an access slot, and upon release of the flexing force each bight portion is adapted to clamp on a marginal edge of the aperture.

* * * * *